United States Patent [19]

Thornton

[11] 4,397,467

[45] Aug. 9, 1983

[54] COMPETITIVE BOARD GAME

[76] Inventor: James H. Thornton, R.R. 2, Box 14, Millstadt, Ill. 62260

[21] Appl. No.: 301,916

[22] Filed: Sep. 14, 1981

Related U.S. Application Data

[63] Continuation of Ser. No. 77,687, Sep. 21, 1979, abandoned.

[51] Int. Cl.[3] ..... A63F 3/00

[52] U.S. Cl. ..... 273/256

[58] Field of Search ..... 273/243, 256, 248, 249, 273/274

[56] References Cited

U.S. PATENT DOCUMENTS 2,976,044 3/1961 Corpening ..... 273/256

3,889,954 6/1975 Malisow ..... 273/256

*Primary Examiner*—Richard C. Pinkham

*Assistant Examiner*—Scott L. Brown

[57] ABSTRACT

Disclosed is a competitive game of the type played with (a) a plurality of differentiated tokens at least one of which is played by each player in the game, (b) a game board having a closed path over which the tokens are moved during play, the closed path comprising a plurality of stations which are correlated with instructions affecting the standing of a player whose token lands on that station, (c) an aleatoric device for determining the number of stations moved by each token on each play, (d) a plurality of markers the accumulation of which by each player evidences his standing in the game, and (e) a plurality of instructional members separate from the stations which likewise are correlated with instructions affecting the standing of a player, these instructional members being related to the stations in that an instruction correlated with a first group of at least some of the stations refers a player whose token lands on one of that group of stations to the next in sequence of the instructional members. The game is characterized in that at least some of the instructions correlated with the first instructional member authorize a player who receives such instructions to gamble markers, the success or failure of the gamble being determined by an aleatoric device.

3 Claims, 11 Drawing Figures

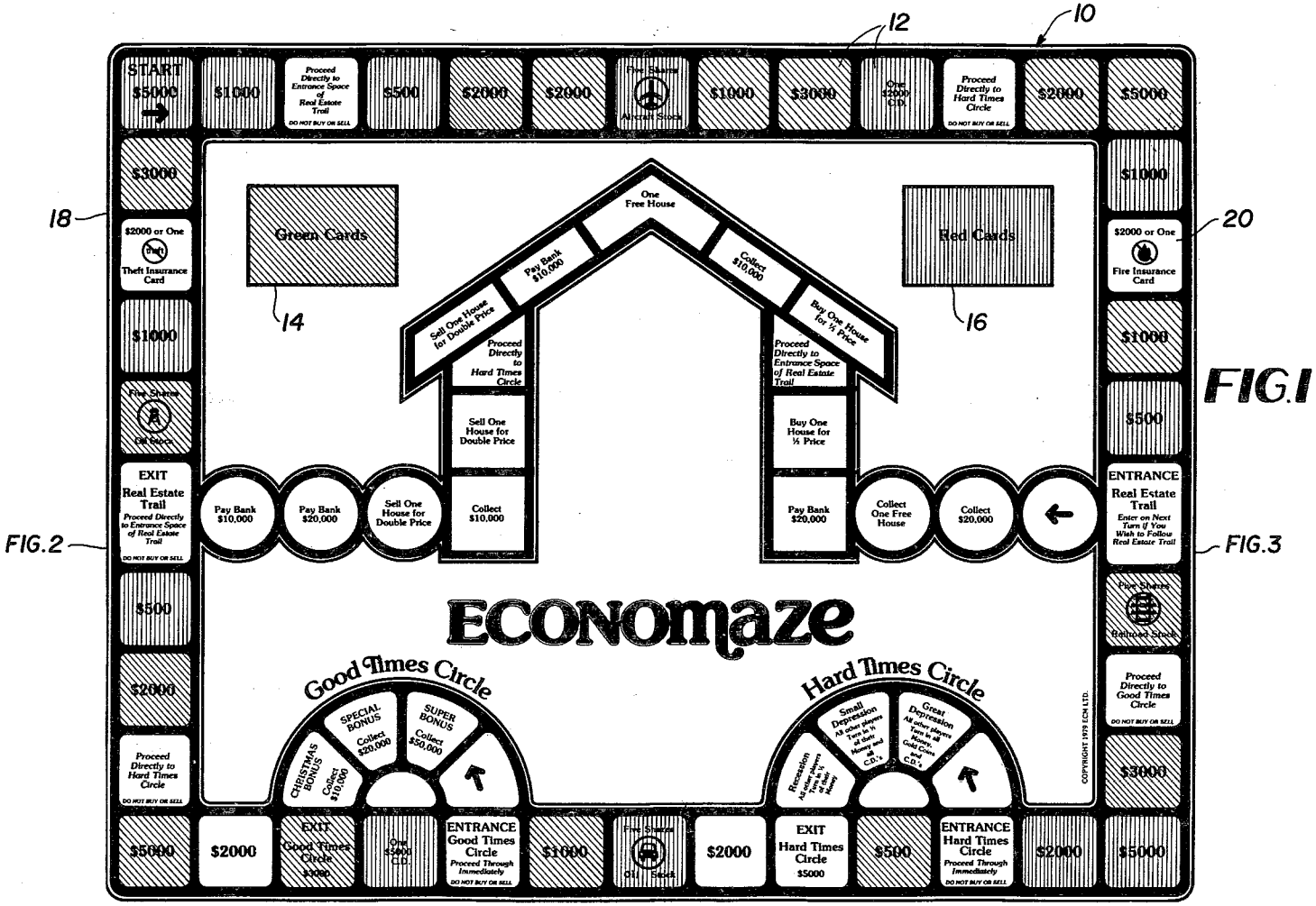
FIG.1
FIG.2
FIG.3
10
12
14
16
18
20
ECONOmaze
Hard Times Circle
Good Times Circle
START $5000
$3000
$2000 or One Theft Insurance Card
$1000
Free Square Bad Stocks
EXIT Real Estate Trail Proceed Directly to Entrance Space of Real Estate Trail DO NOT BUY OR SELL
$500
$2000
Proceed Directly to Hard Times Circle DO NOT BUY OR SELL
$5000
$1000
Proceed Directly to Entrance Space of Real Estate Trail DO NOT BUY OR SELL
$500
$2000
Free Square Auction Stock
$1000
$3000
One $2000 CD
Proceed Directly to Hard Times Circle DO NOT BUY OR SELL
$2000
$5000
$1000
$2000 or One Five Insurance Card
$1000
$500
ENTRANCE Real Estate Trail Proceed Directly Forward Turn If You Wish to Follow Real Estate Trail
Free Shares Railroad Stocks
Proceed Directly to Good Times Circle DO NOT BUY OR SELL
$3000
$5000
$2000
ENTRANCE Hard Times Circle Proceed Through Immediately DO NOT BUY OR SELL
$500
EXIT Hard Times Circle $5000
$2000
Free Square Oil Stocks
$1000
ENTRANCE Good Times Circle Proceed Through Immediately DO NOT BUY OR SELL
One $2000 CD
EXIT Good Times Circle $4000
$2000
Proceed Directly to Hard Times Circle DO NOT BUY OR SELL
$500
$2000
Collect $20,000
Collect One Free House
Pay Bank $20,000
Buy One House for ½ Price
Proceed Directly to Entrance Space of Real Estate Trail
Buy One House for ½ Price
Collect $10,000
One Free House
Pay Bank $10,000
Proceed Directly to Hard Times Circle
Sell One House for Double Price
Collect $10,000
Sell One House for Double Price
Pay Bank $20,000
Pay Bank $10,000
Red Cards
Green Cards
COPYRIGHT 1979 ECM LTD.
Great Depression Alarm Bell Rings Pass Go Collect $10,000
Recession At Most Losers Pay 10% of Their Assets
Small Depression At Most Losers Pay 5% of Their Assets
SUPER BONUS Collect $50,000
BONUS $20,000
CHRISTMAS BONUS Collect $10,000

FIG.4
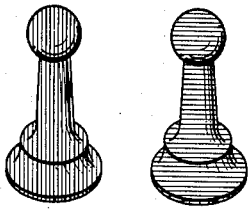
FIG.5
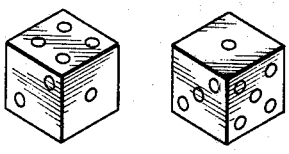
FIG.6
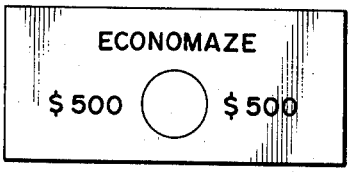
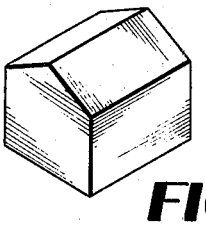
FIG.9
FIG.7
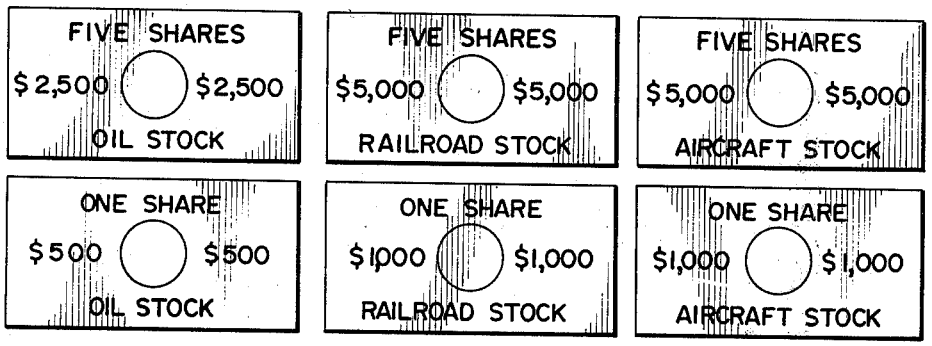
FIG.8
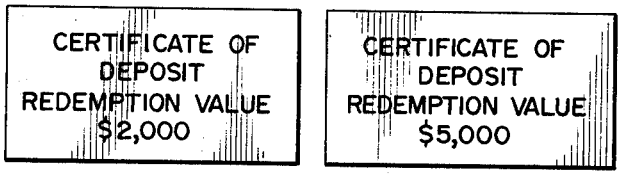
FIG.10
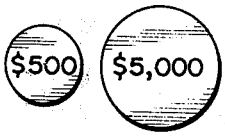
FIG.11
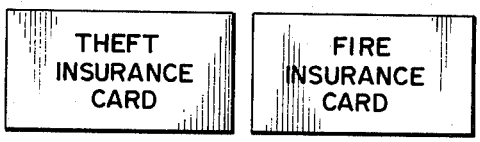

COMPETITIVE BOARD GAME

This is a continuation of application Ser. No. 06/077,687, filed Sept. 21, 1979, now abandoned.

TECHNICAL FIELD

This invention relates to competitive board games of the type wherein pieces move over a board having patterns, a chance device controls the amount or direction of movement of the pieces, and the game relates to property or commodity transactions.

BACKGROUND OF PRIOR ART

There are a multitude of patents on Monopoly-type board games, including U.S. Pat. No. 2,026,082 issued to Charles Darrow on Monopoly itself. Many of the games use forms of property other than real estate, including stocks, bonds, and commodities. Several feature branch paths, including U.S. Pat. No. 2,666,644 to Strehlow et al. and U.S. Pat. No. 3,807,739 to Henley et al., and several are won by accumulating a specified sum of money rather than by bankrupting the other players. Many have features which are common both to Monopoly and to this game—e.g., the banker, sale of assets to other players, good luck and bad luck cards, and the basic aleatoric travel pattern.

In most games known to me, however, a player needs to accumulate items of roughly equivalent value to those accumulated by the other players during the first portion of the game or that player is never in contention. That is, once behind it is nearly impossible to catch up.

BRIEF SUMMARY OF THE INVENTION

In the subject game, which is sold commercially under the trademark ECONOMAZE, it is not necessary for a player to accumulate items of roughly equivalent value to those accumulated by the other players during the first portion of the game in order for that player to remain in contention. Board features such as the "Good Times Circle," the "Hard Times Circle," and the gambling permitted by some of both the red and green cards cause rapid changes in standings. Moreover, strategic buying and selling of assets enables a player to catch up through red and green card events other than gambling. Finally, no player is ever out of the game, since each player receives at least some income during nearly every turn, and that income can be used immediately to acquire property and/or to gamble for further property.

BRIEF DESCRIPTION OF THE DRAWINGS

FIG. 1 is a plan view of the game board used in the subject game.

FIG. 4 is a frontal view of tokens suitable for use in the subject game.

FIG. 5 is a perspective view of a pair of dice suitable for use as an aleatoric device in the subject game.

FIG. 6 is a plan view of cash markers suitable for use in the subject game.

FIG. 7 is a plan view of stock markers suitable for use in the subject game.

FIG. 8 is a plan view of certificate of deposit markers suitable for use in the subject game.

FIG. 9 is a perspective view of a real estate marker, or house, suitable for use in the subject game.

FIG. 10 is a plan view of gold coin markers suitable for use in the subject game.

FIG. 11 is a plan view of insurance cards suitable for use in the subject game.

DETAILED DESCRIPTION OF THE PRESENTLY PREFERRED EMBODIMENT

Game Parts

Figure 2:
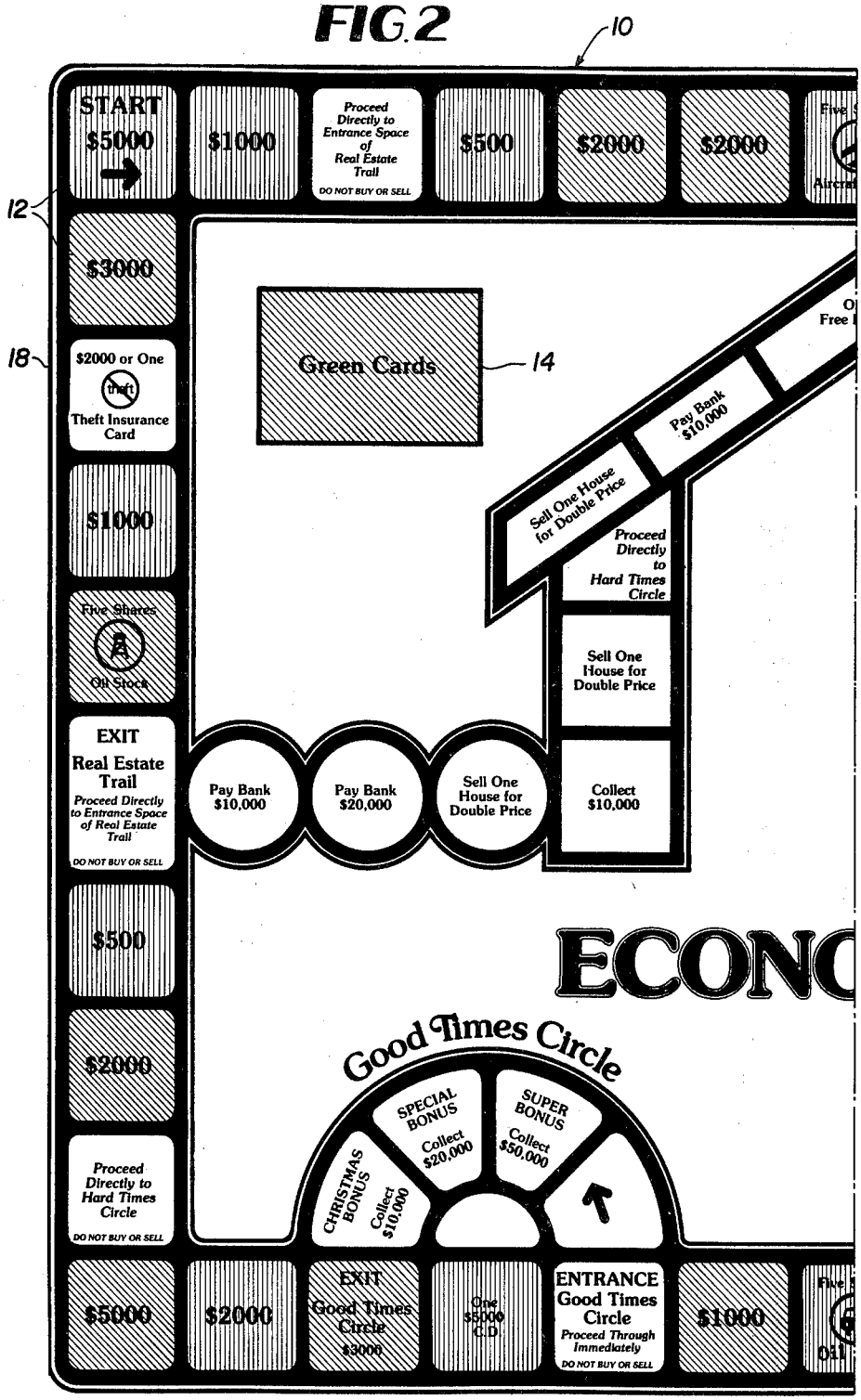
FIG. 2 is a plan view of the left half of the game board used in the subject game.
Figure 3:
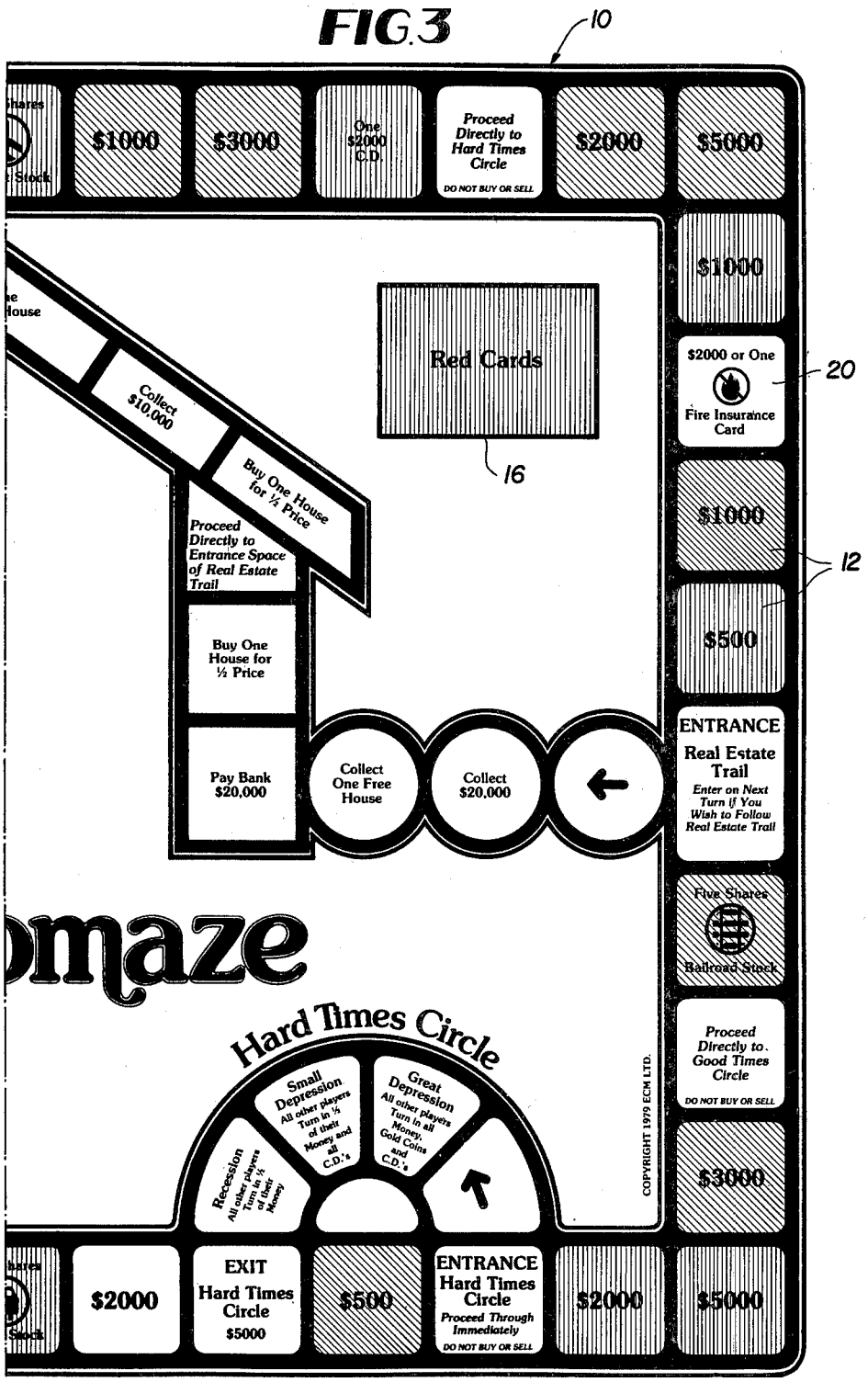
FIG. 3 is a plan view of the right half of the game board used in the subject game.

The subject game is played on a game board the face of which is depicted in FIG. 1. Since it may be made of any appropriate material and since its thickness is irrelevant to the game, the game board is not shown in side or cross-sectional view.

The game is played with a plurality of differentiated tokens at least one of which is played by each player in the game. Such tokens may be differently colored pieces in the shape of chess pawns, as illustrated in FIG. 4, or they may be representations of different animals, objects, etc. as is conventional in MONOPOLY.

On the face of the game board there is a closed path 10 over or through which the tokens are moved during play. The closed path 10 comprises a plurality of stations 12 which are correlated with instructions affecting the standing of a player whose token lands on that station. Preferably, and as shown, the instructions are correlated with each station by printing them thereon, but they need not be correlated so directly. They may, for instance, be printed on a separate instruction sheet to which a player is referred by means of an appropriate symbol which is printed on the station.

The game further comprises an aleatoric device, such as the pair of dice illustrated in FIG. 5, for determining the number of stations moved by each token on each play and a plurality of markers, such as play money (FIG. 6) in denominations of $500, $1,000, $5,000, and $20,000, stock in various companies (FIG. 7) in one and five share denominations, certificates of deposit, or CD's, (FIG. 8) in $2,000 and $5,000 denominations, houses (FIG. 9) having a face value of $20,000, and gold coins (FIG. 10) in $500 and $5000 denominations.

The game further comprises at least one and preferably two sets of instructionsl members 14, 16 which are separate from the stations 12 but which likewise are correlated with instructions affecting the standing of a player. The instructional members 14, 16 are related to the stations 12 in that an instruction correlated with a first group of at least some of the stations refers a player whose token lands on one of that group to the next in sequence of the instructional members 14, and an instruction correlated with a second group of at least some of the stations refers a player whose token lands on one of that group to the next in sequence of the instructional members 16. Preferably, and as shown, the first group of stations is colored green, the second group of stations is colored red, the instructional members 14 are colored green, the instructional members 16 are colored red, and the "instruction" referred to in the foregoing is the color of the station. However, many other forms of instructions correlating the station group and the instructional members 14, 16 could obviously be used. Such instructions could include, for instance, symbols printed on the stations.

Preferably the sequence of the instructional members can be randomized and is done so at the beginning of each game. This can be conveniently effected if the instructional members are decks of cards which can be shuffled before each game. However, the instructional members could also be components in a more elaborate mechanical or electronic randomizing device.

The instructional members in each set 14, 16 preferably contain a plurality of different instructions. In the commercial version of this game, the sets are as follows:

GREEN CARDS

| No. of Members | Instructions |
|---|---|
| 4 | REAL ESTATE BOOM. Collect $5,000 for each house owned. You may sell two houses to the bank for $30,000 each. |
| 1 | GOLD WORTH $400 PER OUNCE. You may sell gold coins to the bank at two times their face value. |
| 2 | GOLD WORTH $600 PER OUNCE. You may sell gold coins to the bank at three times their face value. |
| 2 | GOLD WORTH $1,000 PER OUNCE. You may sell gold coins to the bank at five times their face value. |
| 1 | INTEREST JUMPS. Collect three $2,000 CD's from the bank if you own at least one already. |
| 1 | INTEREST JUMPS. Collect two $5,000 CD's from the bank if you own at least one already. |
| 2 | INTEREST JUMPS. Collect two CD's of each denomination for each CD of that denomination already owned, but do not collect more than four of each denomination. |
| 1 | STOCK MARKET BOOM. Collect five shares of Railroad stock from the bank if you already own at least one share of Railroad stock, and collect five shares of Automobile stock from the bank if you already own at least one share of Automobile stock. You may sell Aircraft and Oil stock to the bank at double their face value. |
| 1 | STOCK MARKET BOOM. Collect five shares of Railroad stock from the bank if you already own at least one share of Railroad stock, and collect five shares of Aircraft stock from the bank if you already own at least one share of Aircraft stock. You may sell Oil and Automobile stock to the bank at double their face value. |
| 1 | STOCK MARKET BOOM. Collect five shares of Oil stock from the bank if you already own at least one share of Oil stock, and collect five shares of Railroad stock from the bank if you already own at least one share of Railroad stock. You may sell Automobile and Aircraft stock to the bank at double their face value. |
| 1 | STOCK MARKET BOOM. Collect five shares of Automobile stock from the bank if you already own at least one share of Automobile stock, and collect five shares of Oil stock from the bank if you already own at least one share of Oil stock. You may sell Aircraft and Railroad stock to the bank at double their face value. |

-continued

GREEN CARDS

| No. of Members | Instructions |
|---|---|
| 1 | STOCK MARKET BOOM. Collect five shares of Oil stock from the bank if you already own at least one share of Oil stock, and collect five shares of Aircraft stock from the bank if you already own at least one share of Aircraft stock. You may sell Automobile and Railroad stock to the bank at double their face values. |
| 1 | STOCK MARKET BOOM. Collect five shares of Aircraft stock from the bank if you already own at least one share of Aircraft stock, and collect five shares of Automobile stock from the bank if you already own at least one share of Automobile stock. You may sell Railroad and Oil stock to the bank at double their face value. |
| 5 | BIG DOUBLES. Bet any amount of cash (including zero) against each player up to the total amount of cash each player has. However, you may not sell your own property in order to raise cash to bet. You get five tries to roll doubles. If you roll a double in five tries, you win; if you do not, you lose. Play against all the other players at the same time. |
| 3 | SEVEN-ELEVEN. Bet any amount of cash (including zero) against each player up to the total amount of cash each player has. However, you may not sell your own property in order to raise cash to bet. Play as many players as you wish, in any order you wish, but one at a time. Take turns rolling dice with you rolling first. The first one to roll a seven or eleven wins. |
| 3 | SHOWDOWN. Bet any amount of cash (including zero) against each player up to the total amount of cash each player has. However, you may not sell your own property in order to raise cash to bet. Play as many players as you wish, in any order you wish, but one at a time. Both players roll dice, and high dice wins. You win ties. |
| 5 | VEGAS. Play "Beat the Dealer" against the bank. Bet any amount of cash (including zero) against the bank up to one-tenth the total amount the bank has and one-tenth the total amount you have. You may not sell your own property in order to raise cash to bet. Both you and the banker roll dice. If you win, collect from the bank amount bet times points you won by. If you lose, pay bank amount bet times points you lost by. You lose ties. |
| 3 | HARD TIMES CIRCLE. Proceed directly to entrance space of Hard Times Circle. |
| 4 | PROMOTION TIME. Collect $10,000 from the bank, and proceed directly to entrance space of Good Times Circle. |

-continued

GREEN CARDS

| No. of Members | Instructions |
|---|---|
| 3 | REAL ESTATE TRAIL. Proceed directly to entrance space of Real Estate Trail. |
| 45 | total Green Cards |

RED CARDS

| No. of Members | Instructions |
|---|---|
| 1 | STOCK MARKET PLUNGE. Turn in to the bank five shares each of Aircraft and Oil stock. |
| 1 | STOCK MARKET PLUNGE. Turn in to the bank five shares each of Aircraft and Automobile stock. |
| 1 | STOCK MARKET PLUNGE. Turn in to the bank five shares each of Railroad and Oil stock. |
| 1 | STOCK MARKET PLUNGE. Turn in to the bank five shares each of Oil and Automobile stock. |
| 1 | STOCK MARKET PLUNGE. Turn in to the bank five shares each of Railroad and Aircraft stock. |
| 1 | STOCK MARKET PLUNGE. Turn in to the bank five shares each of Automobile and Railroad stock. |
| 1 | THEFT. Thieves stole one $5,000 Gold Coin and five shares each of Railroad and Automobile stock. Give them to the player on your right. |
| 1 | THEFT. Thieves stole one $5,000 Gold Coin and five shares each of Aircraft and Oil stock. Give them to the player on your left. |
| 1 | THEFT. Thieves stole two $5,000 Gold Coins and five shares each of Railroad and Aircraft stock. Give them to the player on your right. |
| 1 | THEFT. Thieves stole two $5,000 gold Coins and five shares each of Automobile and Oil stock. Give them to the player on your left. |
| 2 | GOLD PRICE DROPS. Turn in two $5,000 Gold Coins to the bank. |
| 2 | GOLD PRICE DROPS. Turn in four $5,000 Gold Coins to the bank. |
| 1 | STATE TAX TIME. Pay bank $10,000 or one half your money, whichever is less. |
| 2 | FEDERAL TAX TIME. Pay bank $25,000 or one half your money, whichever is less. |
| 4 | INTEREST DROPS. Pay bank $500 for each $2,000 CD your own and $1,000 for each $5,000 CD you own. |
| 2 | SMALL FIRE. Turn in one house to the bank for half price. |
| 2 | GREAT FIRE. Turn in two houses to the bank for half price. |
| 5 | CRAPS. All other players bet any amount of cash they wish (including zero) against you. You must sell assets to the bank if necessary to cover bets, but the other players may not sell assets to the bank to cover their bets. You roll dice until you roll a 2, 3, or 12, in which case you win, or until you roll a 7, in which case you lose. Play against all other players at the same time. |

-continued

RED CARDS

| No. of Members | Instructions |
|---|---|
| 30 | total Red Cards |

Special attention should be given to the instructional members which authorize a player to gamble markers, since such instructional members are a particular feature of this game. In each case the success or failure of the gamble is determined by aleatoric means, which in the preferred form of the game is the same pair of dice which is used to determine the number of stations moved by each token on each play. The odds are preferably calculated, as they are in the instructions given above, to give the advantage to the player when the instructional member is one from the set 14 and to give the disadvantage to the player when the instructional member is one from the set 16. In both cases, however, the gambling element permits rapid swings in the standings of the player.

Instructions correlated with stations 18 and 20 authorize a player whose token lands on those stations to choose to receive an insurance member (FIG. 11) in lieu of another marker, indicated to be $2,000. The insurance members can be retained and used later to cancel the affect of one of the instructional member from the set 16, or it can be sold to another player for a mutually agreeable price. An insurance member can not be sold to the bank. A sale to another player can only take place, however, *before* the other player needs the insurance member to cancel the effect of an instructional member. The value of an insurance member to a player is a function of the value of the assets he owns which are subject to the risk the insurance member cancel plus the value of the prospect of later selling the insurance member to someone else for more.

The game board also has three branch paths each of which connects two points on the closed path.

The first branch path, called the "Real Estate Trail," comprises a plurality of stations which are correlated with instructions affecting the standing of a player whose token lands on that station. Most of the instructions on this branch path relate to the buying and selling of houses (FIG. 9). The Real Estate Trail may be entered only if a player's token lands on or is directed to the entrance space. Entry is on that player's next turn. However, players do not have to enter the Real Estate Trail unless they wish to do so. While on the entry space, a player may buy and/or sell, but he does not collect a salary. When within the Real Estate Trail, a player may not buy gold coins, stocks, or certificates of deposit. Houses may be bought and sold only when on a station that permits such transactions. Houses must be paid for with cash. Gold coins, stocks, and certificates of deposit may not be sold to buy houses. However, they may be sold to make other payments to the bank if the player prefers selling such items to paying in cash, and the cash saved by this expedient may be used to buy a house on a subsequent move if the token subsequently lands on a space authorizing the purchase of a house.

The second branch path, called the "Good Times Circle," also comprises a plurality of stations which are correlated with instructions affecting the standing of a player whose token lands on that station. The instructions on this branch path all relate to the acquisition of relatively valuable cash markers (FIG. 6). The Good Times Circle may be entered only if a player's token lands on or is directed to the entrance space. Entry is immediate and is mandatory. The dice are rolled as many times on that one turn as is necessary to reach the exit space or beyond. If a 2, 3, or 4 is rolled, the player proceeds to the appropriate station, complies with the instructions on that space, and then rolls the dice again for his next move. A player may not buy or sell items when within Good Times Circle. Upon reaching the exit space or beyond, normal play is resumed.

The third branch path, called the "Hard Times Circle," comprises a plurality of stations which are correlated with instructions affecting the standing of the players other than the player whose token has landed on that station. The instructions on this branch path all require the other players to turn relatively valuable markers in to the bank. The other rules relating to the Hard Times Circle are the same as those for the Good Times Circle.

Rules of Play

This game can be played by two, three, or four players ranging in age from ten through adult. The object of the game is to accumulate a specified amount of cash, (which in the commercial embodiment is $150,000 if four players are playing, $200,000 if three players are playing, or $250,000 if two players are playing), to declare that the specified amount has been reached, and to reach the START space or beyond while still retaining the specified amount of cash. Assets other than cash are not counted towards the above sums, but non-cash assets may be sold to the bank or to other players as allowed during a player's turn. Any player unable to pay his debts is out of the game, but the rules of the game are designed to substantially eliminate that possibility.

At the outset of the game, one player is selected to be the banker. He arranges the stocks, money, certificates of deposit, gold coins, and insurance cards in a styrene tray provided with the commercial embodiment of the game (but not illustrated) and issues each player $20,000 initial capital. The green and red cards 14 and 16 are shuffled and placed face down on the indicated spaces on the game board. Each player selects his token and rolls the dice to determine the first player. Play proceeds clockwise around the board, starting at the upper left-hand corner of the board.

On each turn each player rolls the dice, moves his token the number of spaces indicated by the dice, and then takes the following three steps *in the order indicated:*

(1) COLLECT cash, stock, or CD's from the bank in the amount indicated on the station. If the instructions on the station landed on direct the token to another space, the token is moved to the indicated space immediately, and the directions on that space are followed.

(2) BUY or SELL any two items. Players may buy one item and sell one item, buy two items, or sell two items. Also, players do not have to buy or sell any items; that is, they may skip this step entirely at their individual option. Except for the theft and fire insurance cards, items are bought from and sold to the bank. For purposes of buying and selling, the following are considered to be one item:

(a) Any number of one type of stock. (For instance, six Oil and two Railroad stock would count as two items.)
(b) Any number of $2,000 certificates of deposit.
(c) Any number of $5,000 certificates of deposit.
(d) Any number of $500 gold coins.
(e) Any number of $5,000 gold coins.
(f) Any number of houses.
(g) One theft insurance card, which may be bought from and sold to another player only.
(h) One fire insurance card, which may be bought from and sold to another player only.

(3) DRAW a green or red card if so instructed by the directions on the station. (Almost all the stations on the outer, or closed, path do instruct a player whose token lands on them to draw either a green card or a red card.) Follow the instructions on the card. If a red card requires assets to be returned to the bank or to be turned over to another player and the player drawing the card owns less than the number specified on the card, he must return or turn over all of that type of asset that he does own. If a card permits betting against other players or against the bank, the player drawing the card cannot bet more than he has in cash or more than the other player or the bank has in cash. Remember that the size of the bet (i.e., of the potential pay-off) in VEGAS is ten times the amount originally stated (i.e., the maximum possible point spread times the amount stated).

If bank shortages are experienced (i.e., if a green card or instructions on a station permit collecting an asset free or buying it at a reduced price and the bank does not have that asset), players do not collect equivalent cash. That opportunity is simply lost.

Strategy

The rules of this game permit the players to buy and sell assets to take advantage of board movements and red and green card happenings.

It is advantageous for a player to own some of each type of asset in order to take advantage of green card happenings such as STOCK MARKET BOOM, INTEREST JUMPS, and REAL ESTATE BOOM. On the other hand, it is advantageous to have large amounts of cash on hand to take advantage of green card happenings such as BIG DOUBLES, SEVEN-ELEVEN and instructions making it advantageous to own non-cash property, and sixteen contain instructions making it advantageous to own cash. (The other ten contain instructions to proceed to the entrance space of one of the branch paths.) More money can be won on the happenings in the second category than can be made on the happenings in the first category, but the happenings in the second category also carry the risk of loss.

There is a risk to ownership of both cash and non-cash assets when a token has landed on a red space. However, the risk resulting from ownership of non-cash assets is much greater, since twenty-two of the thirty red cards contain instructions making it disadvantageous to own non-cash assets and only the five CRAPS cards and the three TAX cards make it disadvantageous to own cash. On the other hand, more money can be lost on CRAPS than can be lost on the non-cash events. But, on still the other hand, it is of course possible to win at CRAPS, turning the red card happening into a favorable event.

Since all the gambling events are based on simple dice combinations, it is possible for a sophisticated player to ascertain the odds of winning each gambling event and to place his bets accordingly. As previously stated, the odds favor the player on the green card gambling events and are against the player on the red card gambling events.

Features of the Game

Also as previously stated, a principal feature of this game is that it is not necessary to do well at the very outset in order to have a realistic hope of winning. Game elements such as the gambling events and the branch paths permit rapid changes in standings. Also, strategic buying and selling of non-cash assets permits steady, though less spectacular, accumulation of wealth.

Another feature of this game is that players very seldom go bankrupt and are put out of the game while play continues with other players. (In fact, a player can go bankrupt only by recklessly choosing to enter the Real Estate Trail when he has insufficient funds to cover the possible losses consequent upon landing on the four "Pay Bank" stations on that branch.)

Another feature of the game is that the green and red card happenings are realistic happenings which are educational for children in relation to the real economic world and which present challenging decisions for adults to manipulate their holdings for survival and growth.

Yet another feature of this game is that there is a great deal of player involvement, since each player's turn directly involves the other players about a third of the time (i.e., on most of the gambling events, on the Hard Times Circle, and on the THEFT cards).

Caveat

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

I claim:

1. A competitive game wherein:

(a) each player in the game plays with at least one of a plurality of differentiated tokens;

(b) there are a plurality of money markers and property items having predetermined values;

(c) the game is played on a game board having a primary path of stations around the perimeter and three alternate paths, over which tokens are moved during play, said primary path comprising a plurality of stations which are either instructional or color coded and whereby the instructional stations direct that a player will:

(i) receive an insurance card or money marker or;

(ii) be directed to or remain on the instructional station that is the entrance to an alternate path entitled Real Estate Trail or;

(iii) be directed to or immediately proceed through the alternate path entitled Good Times Circle wherein the player may receive a large bonus or;

(iv) be directed to or immediately proceed through the alternate path entitled Hard Times Circle wherein all other players property items and cash markers may be lost and, whereby the color coded stations direct that a player immediately complete the three following sequential steps in the order indicated:

(v) collect money markers or property items from the bank in the amount indicated by the instructions correlated with that station;

(vi) buy or sell any number (including zero) up to a predetermined maximum of property items; and (vii) refer to the next in sequence of a plurality of randomly arranged instructional members which are independent of said stations but which are correlated to the station color code and, whereby none of the instructional or color coded stations may ever be purchased or owned by players and none of the instructional or color coded stations of the primary playing path have any form of landing fees payable either to other players or the bank;

(d) on said primary path each player receives a predetermined value in money markers or property items during every turn except when landing on the instructional station entitled Entrance Real Estate Trail;

(e) there are a plurality of first instructional members which are independent of said stations but which are correlated with instructions that favorably affect the standing of a player in that at least one of said first instructional members make it advantageous to own each category of property items and several of said first instructional members make it advantageous to gamble with other players when that instructional member is referred to;

(f) there are a plurality of second instructional members which are also independent of said stations but which are correlated with instructions that adversely affect the standing of a player in that at least one of said second instructional members makes it disadvantageous to own each category of property items and several of said second instructional members make it disadvantageous to gamble with other players when that instructional member is referred to;

(g) the standing of each player in the game is evidenced by his accumulation of money markers and property items having predetermined values; and (h) the winner of the game is determined by the accumulation of a predetermined value in money markers, declaring said accumulation to the other players and thereafter arriving at a predetermined station, said competitive game comprising the steps of:

(i) determine the number of stations moved by each token on each play by aleatoric means;

(j) move the token to the station determined in step (i) and take the following actions in the order indicated as required;

(i) transfer money markers or property items with the bank in the amount indicated by the instruction correlated with that station;

(ii) buy or sell any number (including zero) up to a predetermined maximum of a predetermined number of categories of property items, whereby said property items may be bought and sold in anticipation of which instructional members will be referred to;

(iii) refer to the next in sequence of a plurality of randomly arranged instructional members which are correlated to the color coding of the station on which a token has landed but which are independent of said stations but which are likewise correlated with instructions affecting the standing of a player;

(iv) when authorized or directed to do so by an instructional member referred to pursuant to step (j) (iii), sell to the bank property items at increased value or turn in to the bank property items at decreased values or pay penalties to the bank for owning specific property items or transfer property items to appropriate player;

(v) when authorized to do so by an instructional member referred to pursuant to step (j) (iii), bet any value in money markers (including zero) against each player up to the total value in money markers (not including the value of property items) that player has;

(vi) engage in the specific gambling game depicted on the instructional member and determine the winner of the bets made pursuant to step (j) (v) by aleatoric means;

(vii) when authorized to do so by an instructional member referred to pursuant to step (j) (iii), all other players bet against the player who has been referred to the instructional member any value in money markers (including zero) up to the total value of money markers and property items held by the player who has been referred to the instructional member; and (viii) engage in the specific gambling game depicted on the instructional member and determine the winner of the bets made pursuant to step (j) (vii) by aleatoric means.

2. The competitive game of claim 1 wherein:

(a) there are a plurality of different categories of property items and a plurality of different categories of gambling games;

(b) at least one of said first instructional members makes it advantageous to own each category of property items when that instructional member is referred to by authorizing the sale of each category of property items to the bank at inflated prices and at least one of said second instructional members makes it disadvantageous to own each category of property items when that instructional member is referred to by directing the sale of each category of property items to the bank at reduced prices or even at total loss;

(c) at least thirty five percent (35%) of said first instructional members depict gambling games wherein the odds of winning are in favor of the player referred to the instructional member thereby making it advantageous for the referred player to bet against other players and whereupon an aleatoric means is used to determine the winner of such gambling games;

(d) at least sixteen percent (16%) of said second instructional members depict gambling games wherein the odds of winning are unfavorable to the player referred to the instructional member thereby making it advantageous for the other players to bet against the referred player and whereupon an aleatoric means is used to determine the winner of such gambling games, whereby said property items may be bought and sold or players may convert property items to money markers to use for gambling purposes in anticipation of which instructional members will be referred to.

3. A competitive game wherein:

(a) each player in the game plays with at least one of a pluarlity of differentiated tokens;

(b) there are a plurality of money markers and property items having predetermined values;

(c) the game is played on a game board having a primary path of stations around the perimeter and three alternate paths, over which tokens are moved during play, said primary path comprising a plurality of stations which are either instructional or color coded and whereby the instructional stations direct that a player will:

(i) receive an insurance card or money marker or;

(ii) be directed to or remain on the instructional station that is the entrance to an alternate path entitled Real Rstate Trail or;

(iii) be directed to or immediately proceed through the alternate path entitled Good Times Circle wherein the player may receive a large bonus or;

(iv) be directed to or immediately proceed through the alternate path entitled Hard Times Circle wherein all other players property items and cash markers may be lost and, whereby the color coded stations which indicated overall conditions as favorable or unfavorable, direct that a player immediately complete the three following sequential steps in the order indicated:

(v) collect money markers or property items from the bank in the amount indicated by the instructions correlated with that station;

(vi) buy or sell any number (including zero) up to a predetermined maximum of property items; and (vii) refer to the next in sequence of a plurality of randomly arranged instructional members which are independent of said stations but which are correlated to the station color code and, whereby none of the instructional or color coded stations may ever be purchased or owned by players and none of the instructional or color coded stations of the primary playing path have any form of landing fees payable either to other players or the bank;

(d) on said primary path each player on every turn except when landing on the instructional station entitled Entrance Real Estate Trail, receives either money markers or property items from the bank, which precludes any player from ever being eliminated from the game due to the inability to function since possession of any amount of money markers or property items enables a player to advance his standing, through property manipulation or gambling, to the extent that a player reduced to absolute zero holdings can thereafter rally and win the game;

(e) there are a plurality of first instructional members correlated to the color coded stations which are independent of said stations but which are correlated with instructions that favorably affect the standing of a player in that at least one of said instructional members makes it advantageous to own each category of property items when that instructional member is referred to by authorizing the sale of each category of property items to the bank at inflated prices and at least thirty five percent (35%) of said instructional members depict the gambling games Big Doubles, Seven-Eleven, Showdown, or Vegas wherein the odds of winning are in favor of the player referred to the instructional member thereby making it advantageous for the referred player to bet against other players;

(f) there are a plurality of second instructional members correlated to the color coded stations which are independent of said stations but which are correlated with instructions that adversely affect the standing of a player in that at least one of said instructional members makes it disadvantageous to own each category of property items when that instructional member is referred to by directing the sale of each category of property items to the bank at reduced prices or even at total loss and at least sixteen percent (16%) of said instructional members depict the gambling game Craps, wherein the odds of winning are unfavorable to the player referred to the instructional member thereby making it advantageous for the other players to bet against the referred player;

(g) the winner of the game is determined by the accumulation of a predetermined value in money markers, declaring said accumulation to the other players and thereafter arriving at a predetermined station, said competitive game comprising the steps of (h) determine the number of stations moved by each token on each play by aleatoric means;

(i) move the token to the station determined in step (i) and if such station is an instructional station the player will:

(i) receive either an insurance card or money marker or;

(ii) be directed to or remain on the station that is entitled Entrance Real Estate Trail whereupon decision to enter or not must be made on that players next turn (entry is always optional) with such decision affecting that players standing since the stations within Real Estate Trail offer higher rewards with higher risk factors, and the only stations where a player can be eliminated from the game being within The Real Estate Trail or;

(iii) be directed to the entrance station of Good Times Circle whereupon the player must continue taking turns until completely through Good Times Circle wherein if the player lands on a station within Good Times Circle that player will receive a money marker bonus or;

(iv) be directed to the entrance station of Hard Times Circle whereupon the player must continue taking turns until completely through Hard Times Circle wherein if the player lands on a station within Hard Times Circle all other players will lose predetermined amounts of property items and money markers up to the entire amount owned, when the station moved to is a color coded station the player will immediately complete the three following steps in the order indicated as part of that turn:

(v) step 1—collect money markers or property items from the bank in the amount indicated by the instructions correlated with that station;

(vi) step 2—buy or sell any number (including zero) up to a predetermined maximum of a predetermined number of categories of property items, whereby such property items may be bought and sold in anticipation of which instructional member will be referred to wherein a player may either buy stock in anticipation of the instructional member permitting the sale of such stock at inflated prices, or sell gold in anticipation of an instructional member directing the player to turn in gold for a total loss, or sell property items to establish holdings in money markers in anticipation of an instructional marker permitting gambling, or take any of the one hundred twenty nine (129) buy/sell variations provided by the game;

(vii) step 3—refer to the next in sequence of a plurality of randomly arranged first or second instructional members which are correlated to the color coding of the station on which a token has landed but which are likewise correlated with instructions affecting the standing of a player;

(viii) when authorized or directed to do so by an instructional member referred to pursuant to step (i) (vii), sell to the bank property items at increased value or turn in to the bank property items at decreased value or pay penalties to the bank for owing specific property items or transfer property items to appropriate player;

(ix) when authorized to do so by first instructional member referred to pursuant to step (i) (vii), bet any value in money markers (including zero) against the bank or each player up to the total value in money markers (not including the value of property items) that the player has;

(x) engage in the specific gambling game named Big Doubles, Seven-Eleven, Showdown or Vegas depicted on the first instructional member whereas these gambling games are designed for the purpose of placing the odds of winning the bet in favor of the player referred to the instructional member thereby making it advantageous for the referred player to bet against other players and since the winner is determined by aleatoric means the gambling game creates suspense and excitement for all players as they all have a good possibility of winning the bet and thereby immediately moving into an improved position even though the referred player has preferrential odds;

(xi) when authorized to do so by a second instructional member referred to pursuant to step (i) (vii), all other players bet any value in money markers (including zero) against the referred player up to the total value of money markers and property items held by the referred player whereupon the referred player must sell to the bank as many property items as necessary to cover all bets made by the other players;

(xii) engage in the specific gambling game named Craps depicted on the second instructional member whereas this gambling game is designed to make the odds of winning favor the betting players rather than the referred player thereby making it advantageous for the other players to bet against the referred player and since the winner is determined by aleatoric means this gambling game creates suspense and excitement for all players as the players making the bets have the favorable odds of winning the bet and thereby moving into an improved position while at the same time the referred player has a good possibility of winning the bet.

* * * * *